US007628463B2

(12) United States Patent
Sasaki

(10) Patent No.: US 7,628,463 B2
(45) Date of Patent: Dec. 8, 2009

(54) IMAGING FORMING APPARATUS

(75) Inventor: Shino Sasaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 289 days.

(21) Appl. No.: 11/795,356

(22) PCT Filed: Nov. 30, 2006

(86) PCT No.: PCT/JP2006/024407

§ 371 (c)(1),
(2), (4) Date: Jul. 13, 2007

(87) PCT Pub. No.: WO2007/066703

PCT Pub. Date: Jun. 14, 2007

(65) Prior Publication Data

US 2008/0150983 A1 Jun. 26, 2008

(30) Foreign Application Priority Data

Dec. 5, 2005 (JP) ..... 2005-350090
Oct. 5, 2006 (JP) ..... 2006-273543

(51) Int. Cl.
*B41J 29/38* (2006.01)

(52) U.S. Cl. ..... 347/11; 347/10

(58) Field of Classification Search ..... 347/11
See application file for complete search history.

(56) References Cited

U.S. PATENT DOCUMENTS 6,328,395 B1 12/2001 Kitahara et al.
2003/0067500 A1* 4/2003 Fujimura et al. ..... 347/11
2005/0200640 A1* 9/2005 Hasenbein et al. ..... 347/11

FOREIGN PATENT DOCUMENTS

| | | |
|---|---|---|
| JP | 63-31237 | 2/1988 |
| JP | 10-81012 | 3/1998 |
| JP | 2000-355159 | 12/2000 |
| JP | 3235229 | 9/2001 |
| JP | 2003-200572 | 7/2003 |
| JP | 2005-41039 | 2/2005 |

* cited by examiner

*Primary Examiner*—Matthew Luu
*Assistant Examiner*—Brian J Goldberg
(74) *Attorney, Agent, or Firm*—Cooper & Dunham, LLP

(57) ABSTRACT

An image forming apparatus is disclosed that includes a recording head including a nozzle from which liquid droplets are ejected, a pressure chamber communicating with the nozzle and containing liquid, and a pressure generation part changing the volume of the pressure chamber; and a drive signal generation part generating a drive signal including multiple drive pulses and causing the pressure generation part to operate so that the liquid droplets are ejected. The drive signal generated by the drive signal generation part includes, within a single print cycle, a resonant drive pulse causing a first one of the liquid droplets to be ejected using the natural vibration period of the pressure chamber, a non-resonant drive pulse causing a second one of the liquid droplets to be ejected without using the natural vibration period of the pressure chamber, and a slight drive pulse prevented from causing the ink droplets to be ejected.

11 Claims, 11 Drawing Sheets

IMAGING FORMING APPARATUS

TECHNICAL FIELD

The present invention relates generally to image forming apparatuses, and more particularly to preventing nozzles that eject liquid droplets from being clogged and to increasing the speed of image formation.

BACKGROUND ART

Ink-jet recording apparatuses, which can perform recording at high speed, can perform recording on plain paper without a special fixing operation, and can be obtained at relatively low prices, have often been used for many purposes of late. Using an ink-jet head in which ink liquid chambers and nozzles communicating therewith are formed, the ink-jet recording apparatus forms an image by causing ink droplets to fly from the nozzles to adhere to a recording medium such as paper or a film by applying pressure to ink in the ink liquid chambers in accordance with image information.

In the case of performing printing on plain paper in particular using this ink-jet recording apparatus, there are explicit problems of image quality degradation characteristic of the ink-jet recording apparatus in the color reproducibility, durability, lightfastness, ink drying characteristic, feathering, color bleeding, and duplex printing characteristic of an image. Further, it is extremely difficult to perform high-speed printing on plain paper while satisfying all of these characteristics.

Usually, common ink used for ink-jet printing contains water as its principal component, and further includes a coloring agent and a wetting agent for clogging prevention, such as glycerin. The coloring agent is either dye or pigment. Conventionally, dye ink is more often used for color parts because of good color development and stability. However, the image fastness properties such as lightfastness and waterfastness (water resistance) obtained by using the dye ink are inferior to those obtained by using pigment as a coloring agent. In particular, the waterfastness is unsatisfactory in the case of using plain paper although it is possible to make a certain degree of improvement by using ink-jet recording paper having an ink absorbing layer.

Therefore, in these years, use of pigment ink, which employs an organic pigment or carbon black as a coloring agent, for plain paper printing has been studied or put into practice in order to reduce the problems of the dye ink in the case of using plain paper. Unlike dye, pigment is not soluble in water. Accordingly, pigment is usually mixed with a dispersing agent so as to be stably dispersed in water by dispersing to be employed as water-based ink. By thus using pigment, the lightfastness and waterfastness can be improved. It is difficult, however, to satisfy the lightfastness and waterfastness and other image quality characteristics at the same time. In particular, in the case of performing high-speed printing on plain paper, it is difficult to obtain high image density, sufficient color development, and sufficient color reproducibility, and characteristics such as feathering, color bleeding, the duplex printing characteristic, and the ink drying (fixation) characteristic are not satisfactory enough, either.

For example, Japanese Laid-Open Patent Applications No. 6-171072 (JP6-171072) and No. 2000-355159 (JP2000-355159) disclose recording methods that solve problems in the case of performing printing on plain paper using such pigment ink. According to the ink-jet recording method disclosed in JP6-171072, an ink containing a pigment, a polymer dispersing agent, and a resin emulsion is employed. The amount of adhesion of solid content per unit area on recording paper at the time of high-duty printing is controlled to be in an appropriate range, so that printing unevenness due to pigment agglomeration is reduced regardless of paper type, thereby obtaining image quality of high density without feathering. Further, according to the ink-jet recording method disclosed in JP2000-355159, an ink composition including a pigment and a penetrant is employed, where the pigment is a surface-treated pigment having a dispersive group on its surface so as to be dispersible in an aqueous solvent by itself. The amount of ejection of the ink composition onto the recording medium side per unit area is controlled so as to prevent generation of irregular bleeding of a printed image, and the ejected ink composition is quickly dried on the recording medium, thereby obtaining a printed image of high printing density.

According to the recording method disclosed in JP6-171072, the contact angle of the employed ink with respect to sized paper such as plain paper is extremely high, such as greater than or equal to 70°, so that there are improvements such as increased printing density and reduced feathering. However, in the case of performing printing on recording paper at high duty, as much as several tens of ng/m$^2$ of adhesion of solid content per unit area is required, thus causing a problem in terms of the ink fixation (drying) characteristic. In particular, in the case of performing high-speed printing with multiple stacked sheets of paper, there is the problem of paper contamination due to ink transfer between paper sheets. Accordingly, this recording method is not suitable for high-speed printing. Further, there is also a problem in that the background of paper appears as white stripes in a solid part or a characters part because of the high contact angle at the time of 100% duty printing depending on a paper type. Further, adjacent printed dots remain liquid droplets because of the high contact angle, so that the problem of color bleeding is likely to occur at the boundary between colors.

On the other hand, the recording method disclosed in JP2000-355159, which uses a penetrant, is advantageous in image quality because of ink dryness (fixation). Since the problem of paper contamination due to ink transfer between paper sheets is not caused in the case of performing high-speed printing with multiple stacked paper sheets, this recording method is suitable for high-speed printing. However, since the penetrant is employed in the ink composition, feathering occurs at the time of performing printing on plain paper the same as in the case of dye ink. In the case of plain paper in particular, the ink also penetrates in the direction of the depth of the paper, so that strike-through of the ink occurs, thus making it difficult to perform duplex printing. Accordingly, it is difficult for either one of the recording methods of JP6-171072 and JP2000-355159 to obtain a high-quality image that is fully satisfactory in all of the above-described characteristics in high-speed printing on plain paper.

It is effective to employ high-viscosity ink in order to form a high-quality image on plain paper at high speed by solving the problems caused in plain paper printing by using the pigment ink. However, in the case of employing high-viscosity ink, all nozzles in a non-printing area and those of the nozzles in a printing area that are not in printing operation are clogged so as to extremely degrade image quality when the ink is dried to be higher in viscosity around the menisci of the nozzles. Further, even if the nozzles are not clogged, it may be impossible to obtain stable ink droplet ejection characteristics (droplet velocity, droplet volume, and curving in the droplet ejection direction), so that the image quality may be degraded. In order to prevent these problems, the ink-jet recording apparatus disclosed in Japanese Laid-Open Patent Application No. 2005-41039 (JP2005-41039) generates multiple ejection drive pulses and multiple non-ejection drive pulses in one print cycle. The ejection drive pulses are output in time series in order to eject liquid droplets. The non-ejection drive pulses provide a meniscus with vibration that is so slight that an ink droplet is not ejected. Each non-ejection drive pulse include a first signal that expands a pressure chamber communicating with a nozzle, a second signal that retains the expanded state of the pressure chamber after the first signal, and a third signal that contracts the pressure chamber after the third signal. Further, with respect to the ejection drive pulses, the interval between a drive pulse and its preceding drive pulse (pulse interval) is three to five times the natural frequency of the pressure chamber.

When a first signal that expands a pressure chamber communicating with a nozzle, a second signal that retains the expanded state of the pressure chamber after the first signal, and a third signal that contracts the pressure chamber after the third signal are included as a non-ejection pulse in one print cycle as shown in JP2005-41039, the signal length of the non-ejection pulse increases so as to prevent printing speed from increasing.

Further, if the pulse interval of multiple ejection drive pulses output in time series in one print cycle is three to five times the natural frequency of the pressure chamber, one print cycle, that is, the drive signal length, increases so as to reduce printing speed.

DISCLOSURE OF THE INVENTION

Embodiments of the present invention may solve or reduce one or more of the above-described problems.

According to one embodiment of the present invention, there is provided an image forming apparatus in which one or more of the above-described problems are solved.

According to one embodiment of the present invention, there is provided an image forming apparatus in which all nozzles in a non-printing area and those of the nozzles in a printing area that are not in printing operation are prevented from being clogged by ink drying around the menisci of the nozzles even in the case of using high-viscosity ink; a slight drive pulse that provides vibration to a meniscus without causing a liquid droplet to be ejected is employed in one print cycle so as to prevent dryness from changing the physical properties of the ink and adversely affecting liquid ejection characteristics; and higher printing speed is achieved.

According to one embodiment of the present invention, there is provided an image forming apparatus including: a recording head including a nozzle from which liquid droplets are ejected, a pressure chamber communicating with the nozzle and containing liquid, and a pressure generation part changing a volume of the pressure chamber; and a drive signal generation part configured to generate a drive signal including multiple drive pulses, the drive signal causing the pressure generation part of the recording head to operate so that the liquid droplets are ejected from the nozzle, wherein the drive signal generated by the drive signal generation part includes, within a single print cycle, a resonant drive pulse causing a first one of the liquid droplets to be ejected using a natural vibration period of the pressure chamber, a non-resonant drive pulse causing a second one of the liquid droplets to be ejected without using the natural vibration period of the pressure chamber, and a slight drive pulse prevented from causing the ink droplets to be ejected.

According to one aspect of the present invention, by generating a drive signal including multiple drive pulses that causes liquid droplets to be ejected and a slight drive pulse that does not cause a liquid droplet to be ejected within a single print cycle, it is possible to maintain a nozzle in the single print cycle, thus making it possible to increase the speed and stability of printing.

According to another aspect of the present invention, since the drive pulses causing liquid droplets to be ejected include a resonant drive pulse that causes a liquid droplet to be ejected using the natural vibration period of a pressure chamber and a non-resonant drive pulse that causes a liquid droplet to be ejected without using the natural vibration period of the pressure chamber, it is possible to form liquid droplets of a large dot and a medium dot at high speed with stability.

BRIEF DESCRIPTION OF THE DRAWINGS

Other objects, features and advantages of the present invention will become more apparent from the following detailed description when read in conjunction with the accompanying drawings, in which.

BEST MODE FOR CARRYING OUT THE INVENTION

A description is given below, with reference to the accompanying drawings, of an embodiment of the present invention.

Figure 1:
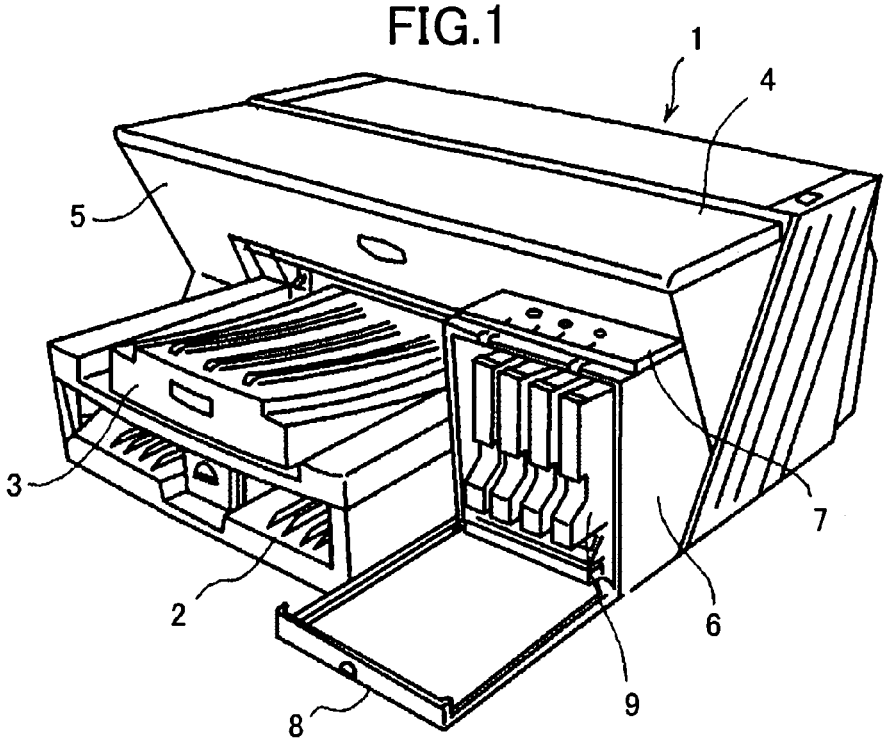
FIG. 1 is a perspective view of an image forming apparatus according to an embodiment of the present invention.

FIG. 1 is a front-side perspective view of an image forming apparatus according to the embodiment of the present invention. The image forming apparatus includes an apparatus main body 1, a paper feed tray 2, and a paper output tray 3. The paper feed tray 2 is attached to the apparatus main body 1 so as to contain recording paper. The paper output tray 3 is attached to the apparatus main body 1 so as to stack recording paper on which an image is recorded (formed). An upper side cover 4 is provided on the upper side of the apparatus main body 1 so as to be openable and closable. A cartridge loading part 6 is provided in a position lower than the upper side cover 4 at one end of a front face 5 of the apparatus main body 1 so as to project toward the front side. An operations part 7 such as an operations panel including operational keys and indicators is provided on the upper side of the cartridge loading part 6. The cartridge loading part 6 has an openable and closable front cover 8 on its front side. Ink cartridges 9 as liquid replenishing parts can be attached and detached by opening the front cover 8.

Figure 2:
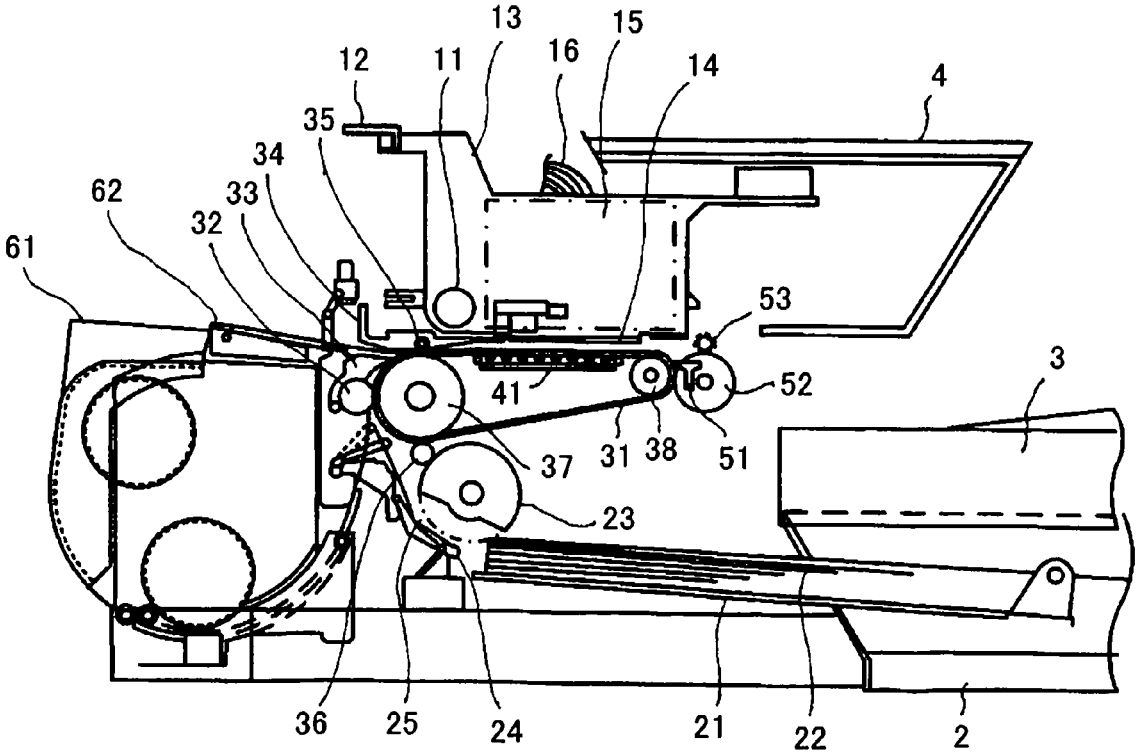
FIG. 2 is a side view of a mechanism part of the image forming apparatus according to the embodiment of the present invention.
Figure 3:
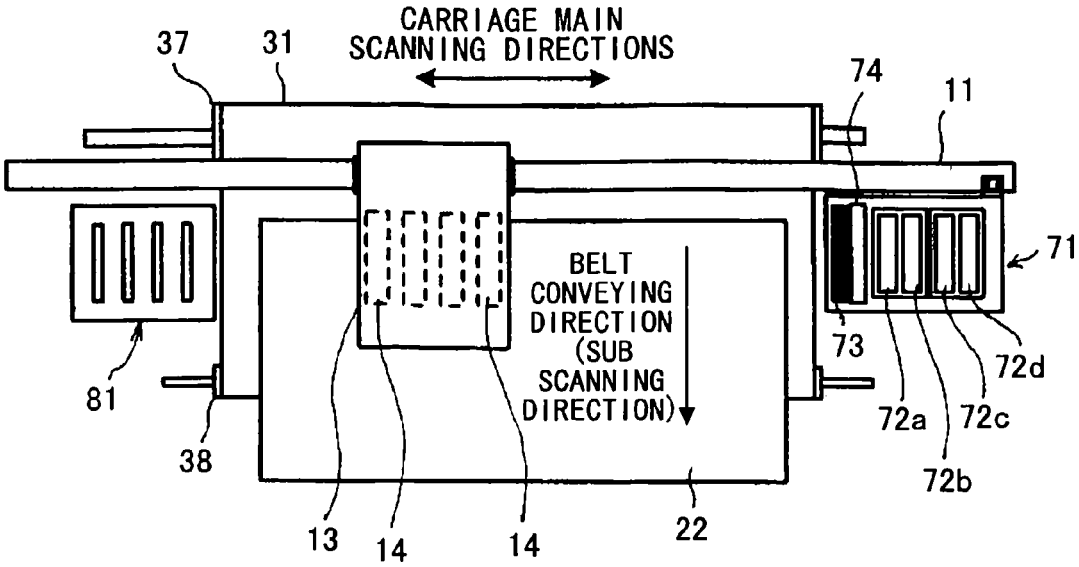
FIG. 3 is a plan view of the mechanism part of the image forming apparatus according to the embodiment of the present invention.

FIGS. 2 and 3 are a side view and a plan view of a mechanism part of the image forming apparatus. According to the mechanism part of the image forming apparatus, as shown in FIGS. 2 and 3, a carriage 13 is held by a guide rod 11, which is a guide member laid across between the side plates of the apparatus main body 1, and a stay 12 so as to be slidable in the main scanning directions (indicated by double-headed arrow in FIG. 3). A main scanning motor 17 (FIG. 7) causes the carriage 13 to move and scan in the carriage main scanning directions. Four recording heads 14 formed of ink-jet heads that eject ink droplets of respective colors of yellow (Y), cyan (C), magenta (M), and black (Bk) are attached to the carriage 13 so that their multiple ink ejection openings are arranged in a direction to cross the main scanning directions and that the multiple ink ejection openings eject ink droplets in a downward direction. The recording heads 14 can employ, as an energy generation part for ejecting ink, a piezoelectric actuator such as a piezoelectric element, a thermal actuator that utilizes a phase change due to the film boiling of liquid using an electrothermal conversion element, a shape-memory alloy actuator that utilizes a metallic phase change due to a change in temperature, and an electrostatic actuator that uses electrostatic force. For example, the recording heads 14 have respective piezoelectric actuators.

Further, sub-tanks 15, which are containers that contain respective color inks and supply the color inks to the corresponding recording heads 14, are mounted on the carriage 13. The color inks are supplied from the ink cartridges 9 of the corresponding colors to the corresponding sub-tanks 15 through corresponding ink supply tubes 16. The ink cartridges 9 contain their respective color inks of yellow (Y), cyan (C), magenta (M), and black (Bk). The sub-tanks 15 for supplying ink to the recording heads 14 and the ink cartridges 9 that replenish the corresponding sub-tanks 15 with ink form a recording liquid supply unit.

A semilunar roller (paper feed roller) 23 that separates and feeds recording paper sheets 22 one by one from a paper stacking part (pressure plate) 21 of the paper feed tray 2 and a separation pad 24 that opposes the paper feed roller 23 and is formed of a material having a large coefficient of friction are provided as a paper feed part for feeding the recording paper sheets 22 stacked on the paper stacking part 21. The separation pad 24 is urged toward the paper feed roller 23 side.

Further, as a conveyance part for conveying each recording paper sheet 22 fed from the paper feed tray 2 from a guide 25 below the recording heads 14, there are provided a conveyor belt 31 for conveying the recording paper sheet 22 while having the recording paper sheet 21 electrostatically attracted and adhered thereto, a counter roller 32 for conveying the recording paper sheet 22 fed from the paper feed part through the guide 25 while holding the recording paper sheet 22 between the counter roller 32 and the conveyor belt 31, a conveyance guide 33 for changing the conveying direction of the recording paper sheet 22 fed upward in a substantially vertical direction by substantially 90° so that the recording paper sheet 22 is on and along the conveyor belt 31, and an edge pressure roller 35 urged toward the conveyor belt 31 side by a holding member 34. Further, a charging roller 36 serving as a charging part for charging the surface of the conveyor belt 31 is provided. Here, the conveyor belt 31 is an endless belt engaged with and provided between a conveyor roller 37 and a tension roller 38 so as to rotate in a belt conveying direction as shown in FIG. 3. The charging roller 36 is disposed in contact with the surface layer of the conveyor belt 31 so as to be rotated by the rotation of the conveyor belt 31. A pressing force of, for example, 2.5 N is applied to each end of the shaft of the charging roller 36.

On the other (bottom) side of the conveyor belt 31, a guide member 41 is disposed in a position corresponding to the area of printing by the recording heads 14. The upper surface of the guide member 41 is positioned on the recording heads 14 side of the tangent line of the conveyor roller 37 and the tension roller 38. As a result, in the area of printing, the conveyor belt 31 is pressed up by the upper surface of the guide member 41 and guided, so that flatness is maintained with high accuracy.

A separation claw 51 for separating the recording paper sheet 22 from the conveyor belt 31, a paper output roller 52, and a paper output roller 53 are provided as a paper output part for outputting the recording paper sheet 22 on which recording has been performed by the recording heads 14. The paper output tray 3 is provided below the paper output roller 52. There is a certain vertical distance between the level of the position between the paper output rollers 52 and 53 and the paper output tray 3 so as to be able to stack a large amount of paper on the paper output tray 3.

Further, a duplex paper feed unit 61 is detachably attached to the rear part of the apparatus main body 1. The duplex paper feed unit 61 takes in the recording paper sheet 22 returned by the reverse rotation of the conveyor belt 31. Then, the duplex paper feed unit 61 reverses the recording paper sheet 22, and feeds the reversed recording paper sheet 22 again to between the counter roller 32 and the conveyor belt 31. A manual paper feed part 62 is provided on the upper side of the duplex paper feed unit 61.

Further, as shown in FIG. 3, a maintenance and recovery mechanism 71 serving as a reliability maintenance part for maintaining and restoring the nozzle status of the recording heads 14 is disposed in one of non-printing areas in the scanning directions of the carriage 13, and a blank ejection (flushing) reception member 81 is disposed in the other one of the non-printing areas. The maintenance and recovery mechanism 71 includes cap members 72*a*, 72*b*, 72*c*, and 72*d* serving as capping parts for capping the nozzle surfaces of the corresponding recording heads 14, a wiper blade 73 serving as a wiping part for wiping the nozzle surfaces, and a blank ejection (flushing) reception member 74.

Figure 4:
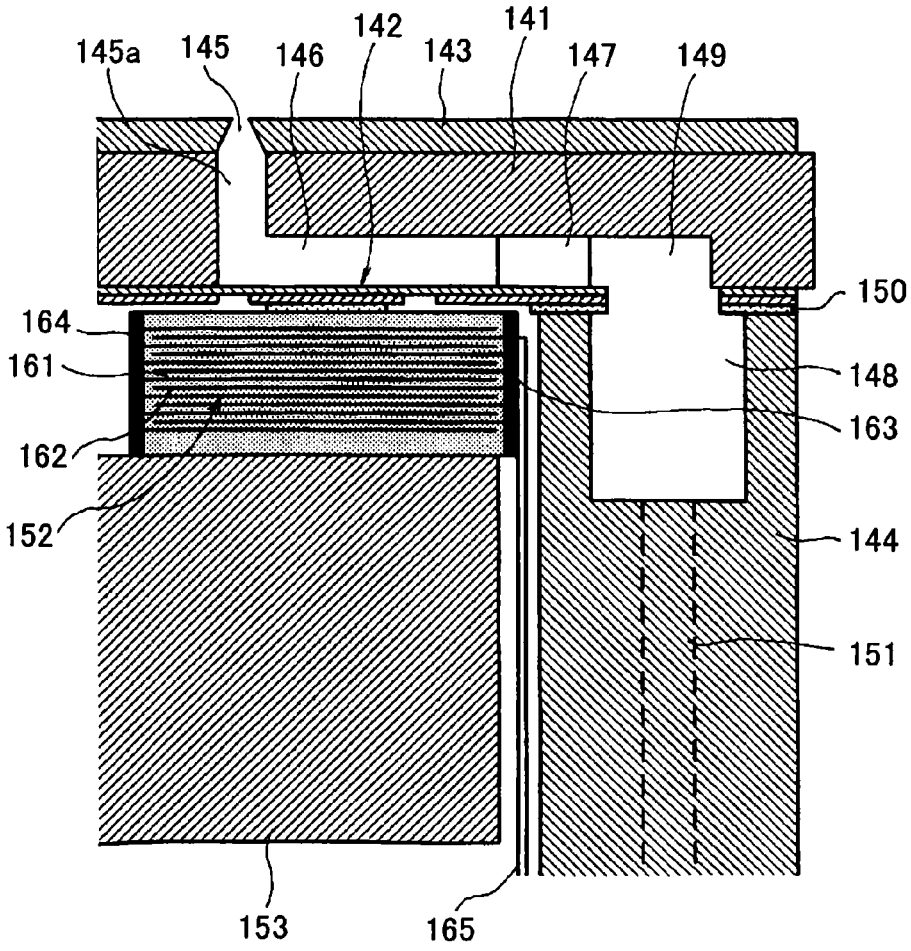
FIG. 4 is a sectional view of part of a recording head taken along the length of a liquid chamber thereof according to the first embodiment of the present invention.
Figure 5:
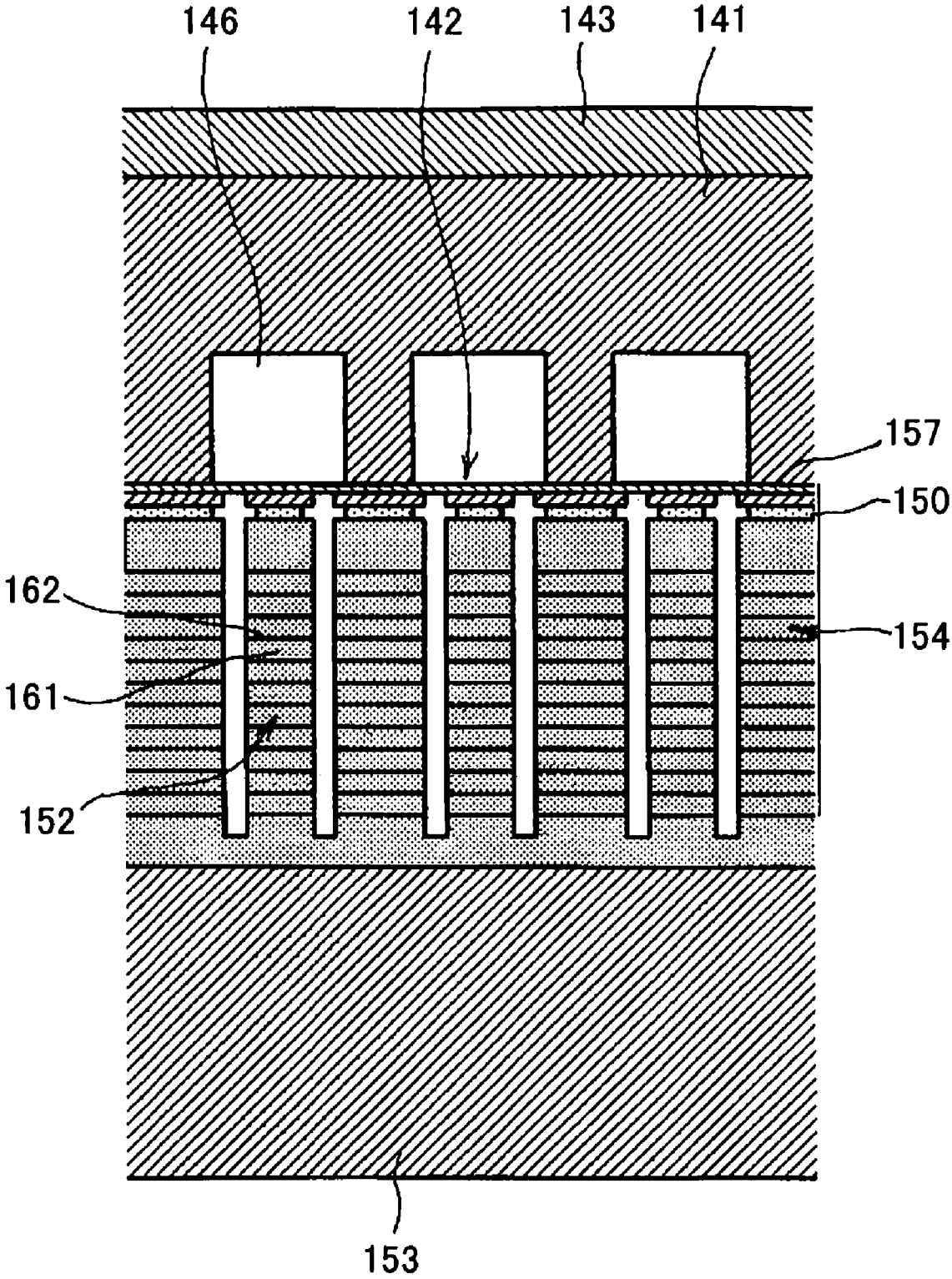
FIG. 5 is a sectional view of part of the recording head taken along the width of a liquid chamber thereof according to the first embodiment of the present invention.
Figure 6:
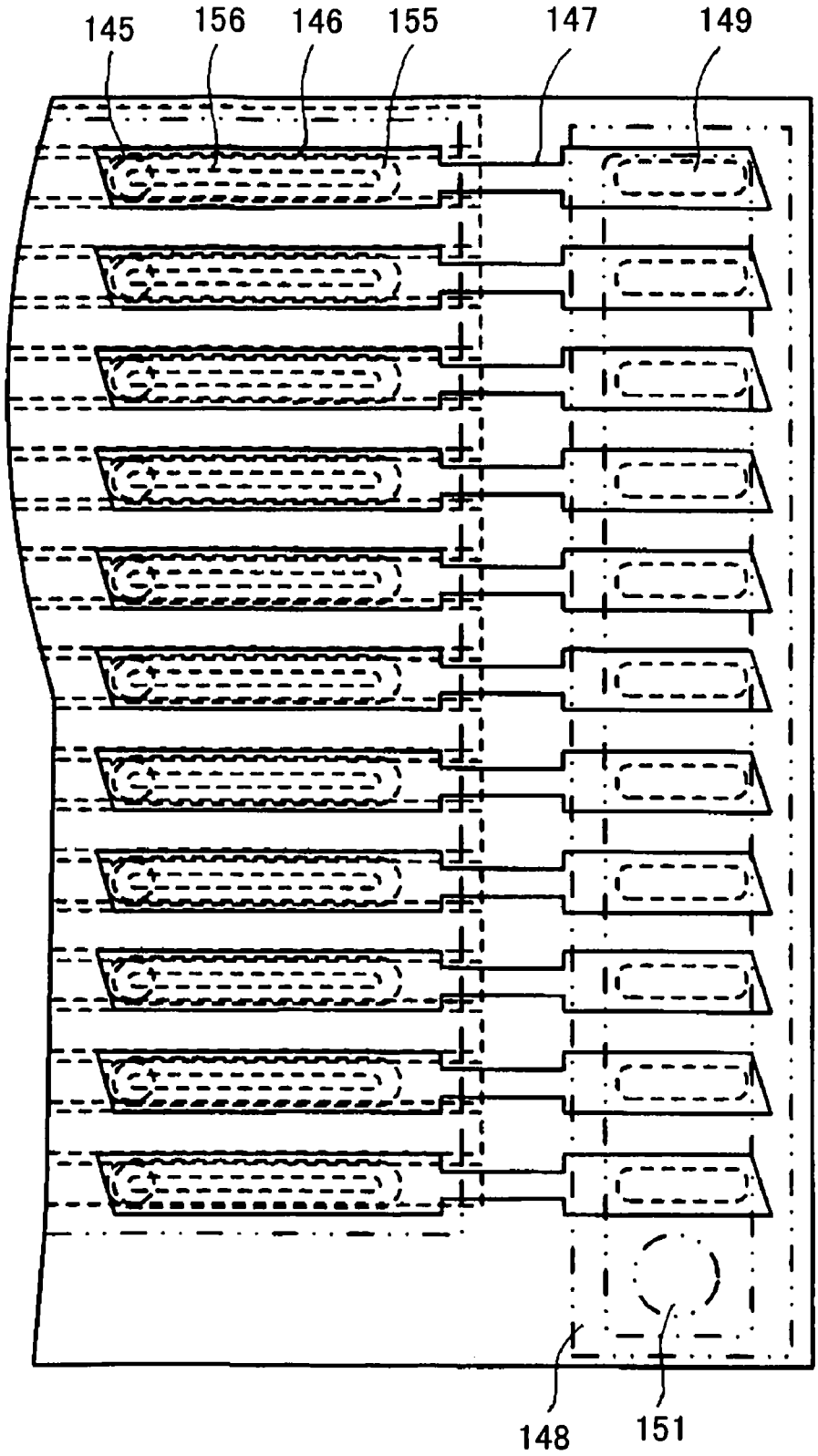
FIG. 6 is a plan view of the recording head according to the embodiment of the present invention.

A description is given below of the recording heads 14, taking one of the recording heads 14 as an example. FIG. 4 is a sectional view of the recording head 14 taken along the length of a liquid chamber thereof. FIG. 5 is a sectional view of the recording head 14 taken along the width of a liquid chamber (or a pressure chamber) thereof. FIG. 6 is a plan view of the recording head 14. As shown in FIGS. 4, 5, and 6, each recording head 14 includes a channel plate 141 formed of a single-crystal silicon substrate, a diaphragm 142 joined to the lower face of the channel plate 141, a nozzle plate 143 joined to the upper face of the channel plate 141, and a frame member 144, which form pressure chambers 146, fluid resistance parts 147, and ink supply openings 149. The pressure chambers 146 serve as ink channels communicating with corresponding nozzles 145 through corresponding nozzle communication channels 145*a*. The nozzles 145 are provided in the nozzle plate 143 so as to let ink droplets be ejected therethrough. The fluid resistance parts 147 serve as the ink supply channels of ink supplied to the pressure chambers 146. The ink is supplied from a common liquid chamber 148 to the fluid resistance parts 147 through the corresponding ink supply openings 149. The common liquid chamber 148 is provided in the frame member 144 so as to reserve (store) the ink to be supplied to the pressure chambers 146.

Stacked piezoelectric elements 152 serving as electromechanical conversion elements that are pressure generation parts (actuator parts) for applying pressure to ink inside the pressure chambers 146 are joined to the surface of the diaphragm 142 on the side opposite to the pressure chambers 146. The piezoelectric elements 152 are joined to a base substrate 153. A columnar support part 154 is provided between each adjacent two of the piezoelectric elements 152 so as to correspond to a partition wall part between corresponding adjacent two of the pressure chambers 146. The piezoelectric elements 152 and the columnar support parts 154 are formed alternately with each other by dividing a piezoelectric element member in a comb teeth manner by performing slit processing thereon with half-cut dicing. The columnar support parts 154 are equal in configuration to the piezoelectric elements 151, but merely serve as columnar supports because no driving voltage is applied thereto. The peripheral part of the diaphragm 142 is joined to the frame member 144 with an adhesive agent 150 including a gap member. The frame member 144 includes an ink supply hole 151 for externally supplying ink to the common liquid chamber 148.

The nozzles 145 of 10 to 35 μm in diameter are formed in the nozzle plate 143 so as to correspond to the pressure chambers 146. The nozzle plate 143 is joined to the channel plate 141 with an adhesive agent. A water-repellant layer subjected to water-repellant surface treatment is provided on the nozzle surface (a surface in the ejection direction; an ejection surface) of the nozzle plate 143. Each piezoelectric element 152 has alternate layers of lead zirconate titanate (PZT) piezoelectric layers 161 each of 10 to 50 μm in thickness and silver-palladium (AgPd) internal electrode layers 162 each of several μm in thickness. The internal electrodes 162 are electrically connected alternately to individual electrodes 163 and a common electrode 164, which are end face electrodes (external electrodes) at end faces. The end face electrode at one end face of the piezoelectric element member is divided by half-cut dicing into the individual electrodes 163, and the end face electrode at the other end face is prevented from being divided because of restricted processing such as cutting out so as to become the common electrode 164 that conducts to each piezoelectric element 152. An FPC cable 165 is connected to the individual electrode 163 of each piezoelectric element 152 by soldering, ACF (Anisotropic Conductive Film) bonding, or wire bonding in order to provide a drive signal thereto. A driver circuit (driver IC) for applying a drive waveform selectively to each piezoelectric element 152 is connected to each FPC cable 165. Further, the common electrode 164 is connected to the ground (GND) electrodes of the FPC cables 165 by way of the electrode layers provided in end parts of the piezoelectric elements 152.

For example, if a drive waveform (a pulse voltage of 10 to 50 V) is applied to one of the piezoelectric element 152 in accordance with a recording signal in the recording head 14 thus configured, a displacement in a stacking direction occurs in the piezoelectric element 152 so as to apply pressure to ink in the corresponding pressure chamber 146 via the diaphragm 142, so that the pressure increases to eject an ink droplet from the corresponding nozzle 145. Thereafter, as the ejection of the ink droplet ends, the ink pressure in the pressure chamber 146 decreases so that a negative pressure is generated in the pressure chamber 146 by the inertia of ink flow and the discharge process of the drive pulse, thus proceeding to an ink filling (supplying) process. At this point, ink supplied from the corresponding sub-tank 15 flows into the common liquid chamber 148, and flows from the common liquid chamber 148 to pass through the ink supply opening 149 and the fluid resistance part 142 so as to fill the pressure chamber 146. The fluid resistance part 147 is effective in attenuating residual pressure vibration after ejection, while serving as resistance to refilling by surface tension. Therefore, by selecting an appropriate fluid resistance of the fluid resistance part 147, it is possible to strike a balance between the attenuation of residual pressure vibration and a refill time, so that it is possible to reduce time required before proceeding to the next ink droplet ejecting operation, that is, a drive cycle.

The ink employed in this image forming apparatus is formed of, for example, pigment (a self-dispersing pigment), a first wetting agent, a second wetting agent, a soluble organic solvent, an anionic or nonionic surfactant, polyol or glycol ether of a carbon number greater than or equal to eight, emulsion, a preservative, a pH adjustor, and pure water. The pigment, which is employed as a coloring agent for printing, and the solvent for dissolving and dispersing the pigment are employed as essential components. The wetting agents, the surfactant, the emulsion, the preservative, and the pH adjustor are employed as additives. The first and second wetting agents are mixed in order to utilize the characteristics of each wetting agent and to facilitate viscosity control.

The pigment is not limited to particular types, and inorganic pigments and organic pigments can be used. As inorganic pigments, in addition to titanium oxide and iron oxide, carbon blacks manufactured by known methods such as the contact, furnace, and thermal processes can be used. Further, as organic pigments, azo pigments (including azo lakes, insoluble azo pigments, condensation azo pigments, and chelate azo pigments), polycyclic pigments (such as phthalocyanine pigments, perylene pigments, perynon pigments, anthraquinone pigments, quinacridone pigments, dioxazine pigments, thioindigo pigments, isoindolinone pigments, and quinophthalone pigments), dye chelates (such as basic dye chelates and acid dye chelates), nitro pigments, nitroso pigments, and aniline black may be employed.

Of these pigments, those having good affinity with water are preferably employed. Preferably, the pigment is less than or equal to 0.05 μm to 10 μm, more preferably less than or equal to 1 μm, and most preferably less than or equal to 0.16 μm in particle size. Further, the load of pigment as a coloring agent in the ink is preferably about 6 to 20 wt %, and more preferably about 8 to 12 wt %.

Specific examples of the pigment for black color include carbon blacks (C.I. pigment black 7) such as furnace black, lampblack, acetylene black, channel black; metals such as copper, iron (C.I. pigment black 11), and titanium oxide; and organic pigments such as aniline black (C.I. pigment black 1).

Specific examples of the pigments for other colors include C.I. pigment yellow 1 (fast yellow G), 3, 12 (disazo yellow AAA), 13, 14, 17, 24, 34, 35, 37, 42 (yellow iron oxide), 53, 55, 81, 83 (disazo yellow HR), 95, 97, 98, 100, 101, 104, 108, 109, 110, 117, 120, 138, and 153; C.I. pigment orange 5, 13, 16, 17, 36, 43, and 51; C.I. pigment red 1, 2, 3, 5, 17, 22 (brilliant fast scarlet), 23, 31, 38, 48:1 (permanent red 2B (Ba)), 48:2 (permanent red 2B (Ca)), 48:3 (permanent red 2B (Sr)), 48:4 (permanent red 2B (Mn)), 49:1, 52:2, 53:1, 57:1 (brilliant carmine 6B), 60:1, 63:1, 63:2, 64:1, 81 (rhodamine 6G lake), 83, 88, 101 (colcothar), 104, 105, 106, 108 (cadmium red), 112, 114, 122 (quinacridone magenta), 123, 146, 149, 166, 168, 170, 172, 177, 178, 179, 185, 190, 193, 209, and 219; C.I. pigment violet 1 (rhodamine lake), 3, 5:1, 16, 19, 23, and 38; C.I. pigment blue 1, 2, 15 (phthalocyanine blue R), 15:1, 15:2, 15:3 (phthalocyanine blue E), 16, 17:1, 56, 60, and 63; and C.I. pigment green 1, 4, 7, 8, 10, 17, 18, and 36.

In addition, graft pigments, which are pigments (for example, carbon) whose surfaces are treated with resin so as to be dispersible in water, and surface treated pigments (for example, carbon) having a functional group such as a sulfone group or a carboxyl group added to their surfaces so as to be dispersible in water can also be employed. Further, pigments encapsulated in microcapsules so as to be dispersible in water may also be employed.

According to a preferred mode of the ink employed in this image forming apparatus, it is preferable that the pigment for black ink be included in ink as a pigment dispersion liquid obtained by dispersing the pigment in an aqueous solvent using a dispersing agent. Preferred examples of the dispersing agent include polyacrylic acid, polymethacrylic acid, acrylic acid-acrylonitrile copolymer, vinyl acetate-acrylate copolymers, acrylic acid-alkyl acrylate copolymers, styrene-acrylic acid copolymer, styrene-methacrylic acid copolymer, styrene-acrylic acid-alkyl acrylate copolymers, styrene-methacrylic acid-alkyl acrylate copolymers, styrene-α-methyl styrene-acrylic acid copolymer, styrene-α-methyl styrene-acrylic acid-alkyl acrylate copolymers, styrene-maleic acid, copolymer, vinyl naphthalene-maleic acid copolymer, vinyl acetate-ethylene copolymer, vinyl acetate-fatty acid vinyl-ethylene copolymer, vinyl acetate-maleate copolymers, vinyl acetate-crotonic acid copolymer, and vinyl acetate-acrylic acid copolymer.

These copolymers are preferably 3,000 to 50,000, more preferably 5,000 to 30,000, and most preferably 7,000 to 15,000 in weight average molecular weight. The amount of addition of the dispersing agent may be suitably determined as long as the pigment is stably dispersed and other effects are not lost. The pigment-dispersive agent ratio is preferably in the range of 1:0.06 to 1:3, and more preferably in the range of 1:0.125 to 1:3.

The proportion of the pigment used as a coloring agent to the total weight of the recording ink is 6 wt % to 20 wt %. The particles of the pigment are less than or equal to 0.05 μm to 0.16 μm in particle size and are dispersed in water by a dispersing agent. The dispersing agent is a polymer disperser having a molecular weight of 5,000 to 100,000. Image quality is improved by using a pyrrolidone derivative, particularly 2-pyrrolidone, as at least one of the water-soluble organic solvents.

Regarding the first wetting agent, the second wetting agent, and the water-soluble organic solvent, for example, the following water-soluble organic solvents are used so that the ink has the desired physical properties and is prevented from being dried, although some inks employ water therein as a liquid medium. It is also possible to use two or more of these water-soluble organic solvents in mixture.

Specific examples of the wetting agents and the water-soluble organic solvent include polyhydric alcohols such as ethylene glycol, diethylene glycol, triethylene glycol, propylene glycol, dipropylene glycol, tripropylene glycol, tetraethylene glycol, hexylene glycol, polyethylene glycol, polypropylene glycol, 1,5-pentanediol, 1,6-hexanediol, glycerol, 1,2,6-hexanetriol, 1,2,4-butanetriol, 1,2,3-butanetriol, and petriol; polyhydric alcohol alkyl ethers such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether; polyhydric alcohol aryl ethers such as ethylene glycol monophenyl ether and ethylene glycol monobenzyl ether; nitrogen-containing heterocyclic compounds such as 2-pyrrolidone, N-methyl-2-pyrrolidone, N-hydroxyethyl-2-pyrrolidone, 1,3-dimethylimidazolidinone, and ε-caprolactam; amides such as formamide, N-methylformamide, and N,N-dimethylformamide; amines such as monoethanolamine, diethanolamine, triethanolamine, monoethylamine, diethylamine, and triethylamine; sulfur-containing compounds such as dimethyl sulfoxide, sulfolane, and thiodiethanol; propylene carbonate; and ethylene carbonate.

Of these organic solvents, diethylene glycol, thiodiethanol, polyethylene glycol 200-600, triethylene glycol, glycerol, 1,2,6-hexanetriol, 1,2,4-butanetriol, petriol, 1,5-pentanediol, 2-pyrrolidone, and N-methyl-2-pyrrolidone are preferred in particular. These organic solvents are excellently effective in terms of solubility and prevention of poor ejection characteristics due to moisture evaporation.

Other preferable examples of the wetting agents are those containing a saccharide. Examples of the saccharides include monosaccharides, disaccharides, oligosaccharides (including trisaccharides and tetrasaccharides), and polysaccharides. Of those, glucose, mannose, fructose, ribose, xylose, arabinose, galactose, maltose, cellobiose, lactose, sucrose, trehalose, and maltotriose are preferable. Here, polysaccharides are broadly interpreted, and are used for the meaning including substances existing widely in nature, such as α-cyclodextrin and cellulose. Further, derivatives of these saccharides include reducing sugars of the above-described saccharides (for example, sugar alcohol, which is expressed by the general formula $HOCH_2(CHOH)_nCH_2OH$, where n is an integer of 2 to 5); oxidized sugars of the above-described saccharides (for example, aldonic acids and uronic acids); amino acids; and thio acids. The sugar alcohol is preferable in particular. Examples of the sugar alcohol include maltitol and sorbitol.

The content of the saccharide is preferably in the range of 0.1 to 40 wt %, and more preferably in the range of 0.5 to 30 wt % of the ink composition.

The surfactant is not limited in particular. Examples of the anionic surfactant include polyoxyethylenealkyletheracetates, dodecylbenzenesulfonates, laurylates, and polyoxyethylenealkylethersulfates. Examples of the nonionic surfactant include polyoxyethylenealkylether, polyoxyethylenealkylester, polyoxyethylenesorvitane fatty acid ester, polyoxyethylenealkylphenylether, polyoxyethylenealkylamine, and polyoxyethylenealkylamide. It is possible to use each of the above-described surfactants independently. It is also possible to use two or more of the above-described surfactants in combination.

The surface tension of ink used in the image forming apparatus is an index of penetration into paper, particularly indicating dynamic surface tension in a short period of time less than or equal to one second after formation of a surface, and accordingly is different from static surface tension measured at the time of saturation of the surface. Any conventional known measurement method may be employed as long as the method is capable of measuring dynamic surface tension in one second or less, such as the one disclosed in Japanese Laid-Open Patent Application No. 63-31237. Here, the surface tension is measured using a Wilhelmy plate tensiometer. Preferably, the surface tension is less than or equal to 40

$mJ/m^2$, and more preferably less than or equal to 35 $mJ/m^2$. This value range makes it possible to obtain excellent fixation and drying characteristics.

Regarding the polyol or glycol ether of a carbon number greater than or equal to eight, it has been found that by adding 0.1 to 10.0 wt % of at least one of partially water-soluble polyol and glycol ether having a solubility between 0.1 and less than 4.5 wt % in 25° C. water to the total weight of the recording ink, the wetting characteristic of the ink with respect to a thermal element is improved and ejection stability and frequency stability are obtained with even a small amount of addition. For example, 2-ethyl-1,3-hexanediol has a solubility of 4.2% (20° C.), and 2,2,4-trimethyl-1,3-petanediol has a solubility of 2.0% (25° C.). A penetrant having a solubility between 0.1 and less than 4.5 wt % in 25° C. water is low in solubility but has the advantage of an extremely high penetration characteristic. Accordingly, it is possible to make an ink having an extremely high penetration characteristic by combining a penetrant having a solubility between 0.1 and less than 4.5 wt % in 25° C. water with another solvent or with a surfactant.

Further, it is preferable that the ink used in the image forming apparatus contain a resin emulsion as an additive. The resin emulsion herein refers to an emulsion that has water as a continuous phase and such a resin component as described below as a dispersed phase. Examples of the resin component of the dispersed phase include acrylic resins, vinyl acetate-based resins, styrene-butadiene-based resins, vinyl chloride-based resins, acryl-styrene-based resins, butadiene-based resins, and styrene-based resins. According to a preferred mode of the ink of this embodiment, the resin is preferably a polymer having a hydrophilic part and a hydrophobic part. Further, the particle size of the resin component is not limited in particular as long as the resin component can form an emulsion. However, the particle size is preferably less than or equal to about 150 nm, and more preferably about 5 to 100 nm. The resin emulsion may be prepared by mixing resin particles with water, in some cases, together with a surfactant. For example, an emulsion of an acrylic resin or styrene-acryl-based resin may be prepared by mixing (meth) acrylic acid ester or styrene and (meth)acrylic acid ester, and in some cases, a surfactant with water. In general, the resin component-surfactant mixture ratio is preferably in the range of 10:1 to 5:1. If the amount of use of the surfactant falls short of the above-described range, the emulsion is less easily formed. On the other hand, using the surfactant in excess of the above-described range is not preferable because the waterfastness of the ink tends to decrease or the penetration characteristic of the ink tends to degrade.

An appropriate ratio of water to resin as the dispersed phase component of the emulsion is 60 to 400 parts by weight, preferably 100 to 200 parts by weight, of water per 100 parts by weight of resin. Examples of the resin emulsion that are commercially available include Micro gel E-1002 and E-5002 (styrene-acryl-based resin emulsions, manufactured by Nippon Paint Co., Ltd.), Boncoat 4001 (an acrylic resin emulsion, manufactured by Dai Nippon Ink and Chemicals Inc.), Boncoat 5454 (a styrene-acryl-based resin emulsion, manufactured by Dai Nippon Ink and Chemicals Inc.), SAE-1014 (a styrene-acryl-based resin emulsion, manufactured by Zeon Corp.), and Saivinol SK-200 (an acrylic resin emulsion, manufactured by Saiden Chemical Industry Co., Ltd.). The resin emulsion is contained so that the resin component thereof is preferably 0.1 to 40 wt %, more preferably 1 to 25 wt %, of the ink.

The resin emulsion as described above has the property of thickening and aggregating, and has the effect of preventing penetration of a coloring component and promoting fixation of a coloring component onto a recording material. Further, some types of resin emulsions form a coating over a recording material, thereby producing the effect of improving the resistance to friction of printed material.

Further, preservatives and fungicides such as sodium dehydroacetate, sodium sorbate, sodium 2-pyridinethiol-1-oxide, sodium benzoic acid, and sodium pentachlorophenol may be used as additives.

As the pH adjustor, any substance that can adjust pH to 7 or higher without adversely affecting ink to be prepared may be used. Examples of the pH adjustor include amines such as diethanolamine and triethanolamine; alkali metal hydroxides such as lithium hydroxide, sodium hydroxide, and potassium hydroxide; ammonium hydroxide; quaternary ammonium hydroxide; quaternary phosphonium hydroxide; and alkali metal carbonates such as lithium carbonate, sodium carbonate, and potassium carbonate. As a chelating reagent, for example, ethylenediamine tetra-sodium acetate, nitrilo tri-sodium acetate, hydroxyethylethylenediamine tri-sodium acetate, diethylenetriamine penta-sodium acetate, and uramil di-sodium acetate may be used. As antirust, for example, acid sulfite, sodium thiosulfate, ammonium thiodiglycolate, diisopropylammonium nitrite, tetra nitric acid pentaerythritol, and dicyclohexylammonium nitrite may be used.

Figure 7:
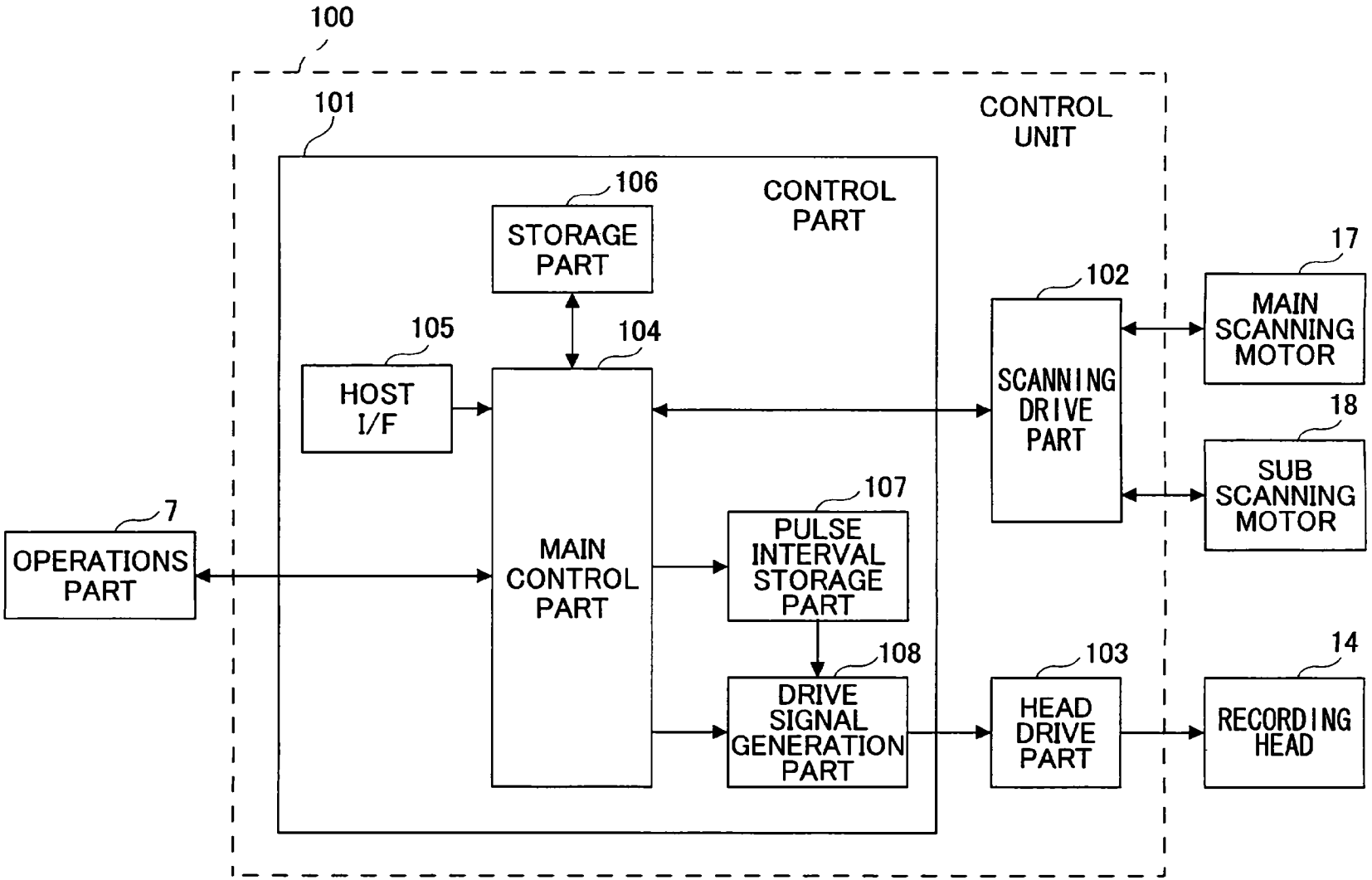
FIG. 7 is a block diagram showing a control unit of the image forming apparatus according to the embodiment of the present invention.

FIG. 7 is a block diagram showing a control unit 100 of the image forming apparatus according to this embodiment. Referring to FIG. 7, the control unit 100 includes a control part 101, a scanning drive part 102, and a head drive part 103. The control part 101 includes a main control part 104, a host interface (I/F) 105, a storage part 106, a pulse interval storage part 107, and a drive signal generation part 108. The main control part 104 manages the operation of the entire apparatus. The host I/F 105 exchanges a variety of information items with a host apparatus. The storage part 106 stores information transmitted from various control programs and the host apparatus. The drive signal generation part 108 generates a drive signal including drive pulses and a slight drive pulse, and outputs the drive signal to the head drive part 103. The drive pulses cause an ink droplet to be ejected from the corresponding nozzle 145 according to a print signal transmitted from the main control part 104 and pulse intervals stored in the pulse interval storage part 107. The slight drive pulse vibrates the meniscus of ink inside the corresponding pressure chamber 146 without causing an ink droplet to be ejected. The scanning drive part 102 is connected to the main scanning motor 17 and a sub scanning motor 18. The head drive part 103 is connected to the recording heads 14. The main control part 104 is connected to the operations part 7.

Figure 8:
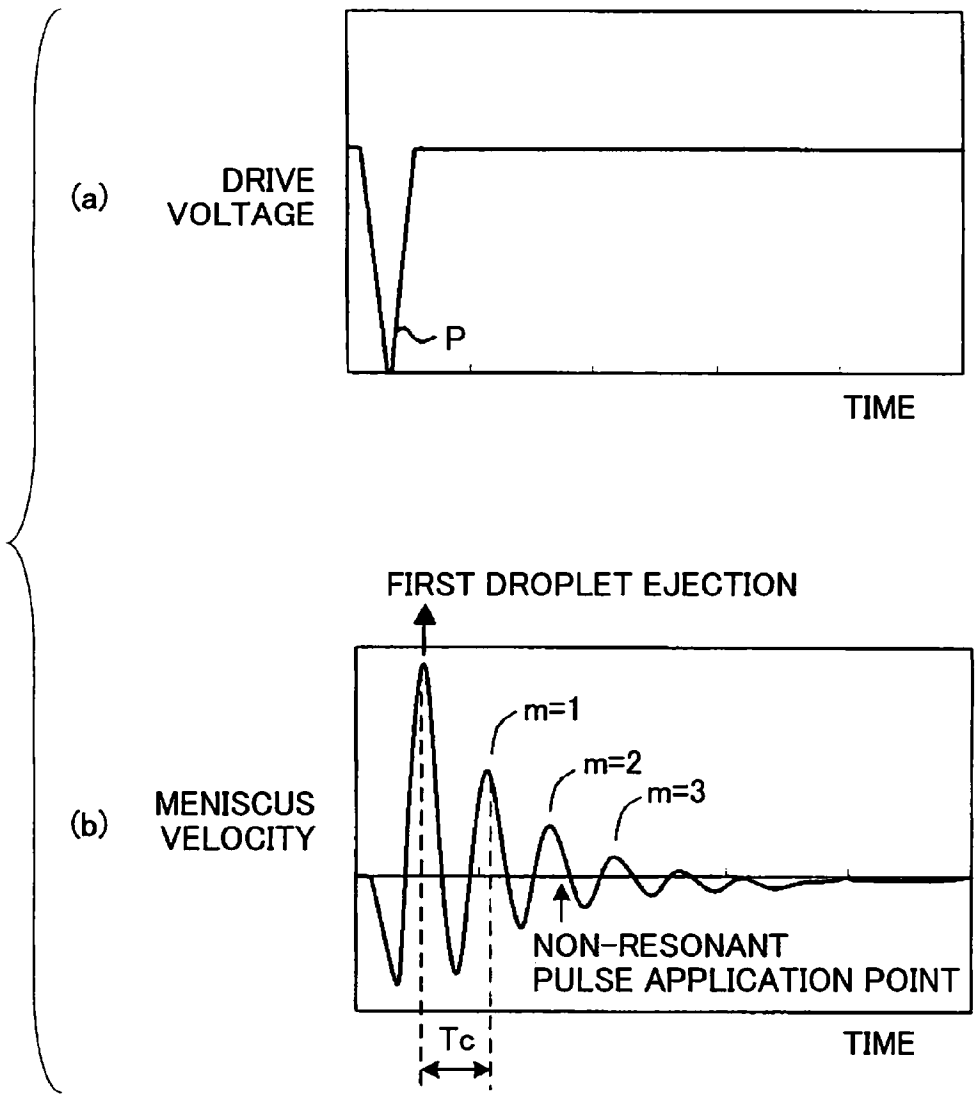
FIG. 8 shows graphs for illustrating a change in meniscus velocity caused by drive pulses according to the embodiment of the present invention.

In the case of ejecting an ink droplet from the nozzle 145 of the recording head 14, if the ink is ejected from the nozzle 145 by one drive pulse P as shown in (a) of FIG. 8, the meniscus velocity of the ink inside the pressure chamber 146 performs damped vibration according to the natural vibration period of the pressure chamber 146. Referring to (b) of FIG. 8, the drive pulses generated and output by the drive signal generation part 108 to eject an ink droplet from the nozzle 145 include a resonant drive pulse Pr (FIG. 9) that resonates with the natural vibration period Tc of the pressure chamber 146 of the recording head 14 and a non-resonant drive pulse Pn (FIG. 9) that does not resonate with the natural vibration period Tc of the pressure chamber 146. The resonant drive pulse Pr is for increasing the volume of an ink droplet by uniting an ink droplet ejected by a first (preceding) drive pulse and an ink droplet ejected by a second drive pulse subsequent thereto in air.

Figure 9:
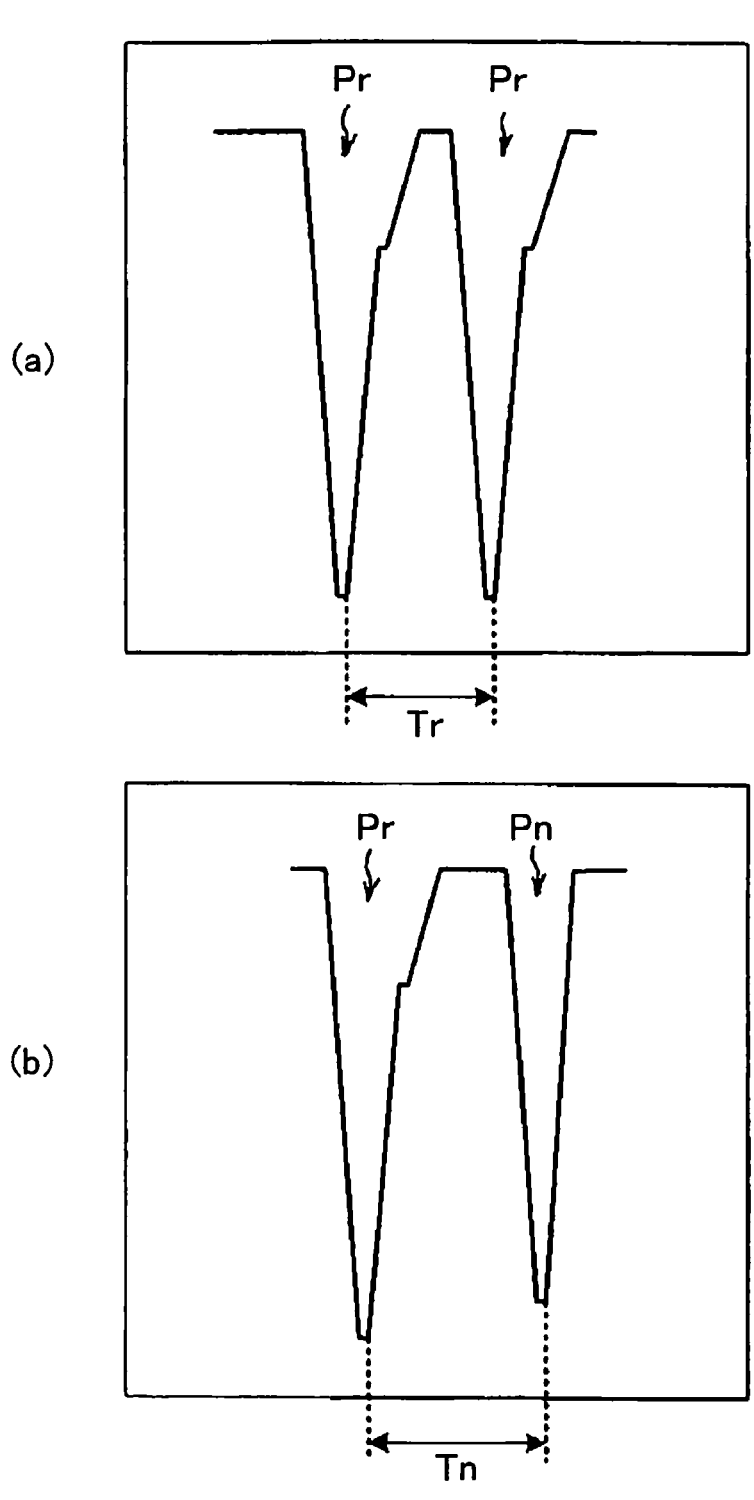
FIG. 9 shows waveform charts showing a resonant drive pulse and a non-resonant drive pulse according to the embodiment of the present invention.

The pulse interval refers to the interval between a drive pulse to cause ink to be ejected from the nozzle 145 of the recording head and its preceding drive pulse. As shown in FIG. 9, a pulse interval Tr for generating the resonant drive pulse Pr that resonates with the natural vibration period Tc of the pressure chamber 146 ((a) of FIG. 9) and a pulse interval Tn for generating the non-resonant drive pulse Pn that does not resonate with the natural vibration period Tc of the pressure chamber 146 ((b) of FIG. 9) are prestored in the pulse interval storage part 107. The pulse interval Tr stored in the pulse interval storage part 107 is defined as $Tr=m\times Tc$ ($m\leqq 2$), for example, $Tr=(2Tc\pm 0.5)$ μs, with respect to the natural vibration period Tc of the pressure chamber 146, that is, the vibration period Tc of the meniscus velocity at the time of causing ink to be ejected from the nozzle 145 by one drive pulse. The pulse interval Tn is defined as a non-integral multiple of the natural vibration period Tc, for example, in the range of $Tn=(m+1/4)\times Tc$ to $Tn=(m+3/4)\times Tc$, that is, in the antiphase area of the natural vibration of the pressure chamber 146. In particular, the pulse interval Tn is defined in the range of $Tn=(m+1/3)\times Tc$ to $Tn=(m+2/3)\times Tc$. Here, it is determined that $m\leqq 2$ for the following reason. The resonant drive pulse Pr is caused to resonate at one of the peak positions m=1-3 of the meniscus velocity change as shown in (b) of FIG. 8. However, if the resonant drive pulse Pr is caused to resonate at the peak position m=3, the position in a waveform for causing the resonant drive pulse Pr to resonate is distant, that is, the pulse interval Tr is long, thus making it impossible to increase speed. Accordingly, the pulse interval Tr for the resonant drive pulse Pr is determined as $Tr=m\times Tc$ ($m\leqq 2$) with respect to the natural vibration period Tc of the pressure chamber 146, thereby increasing printing speed.

Figure 10:
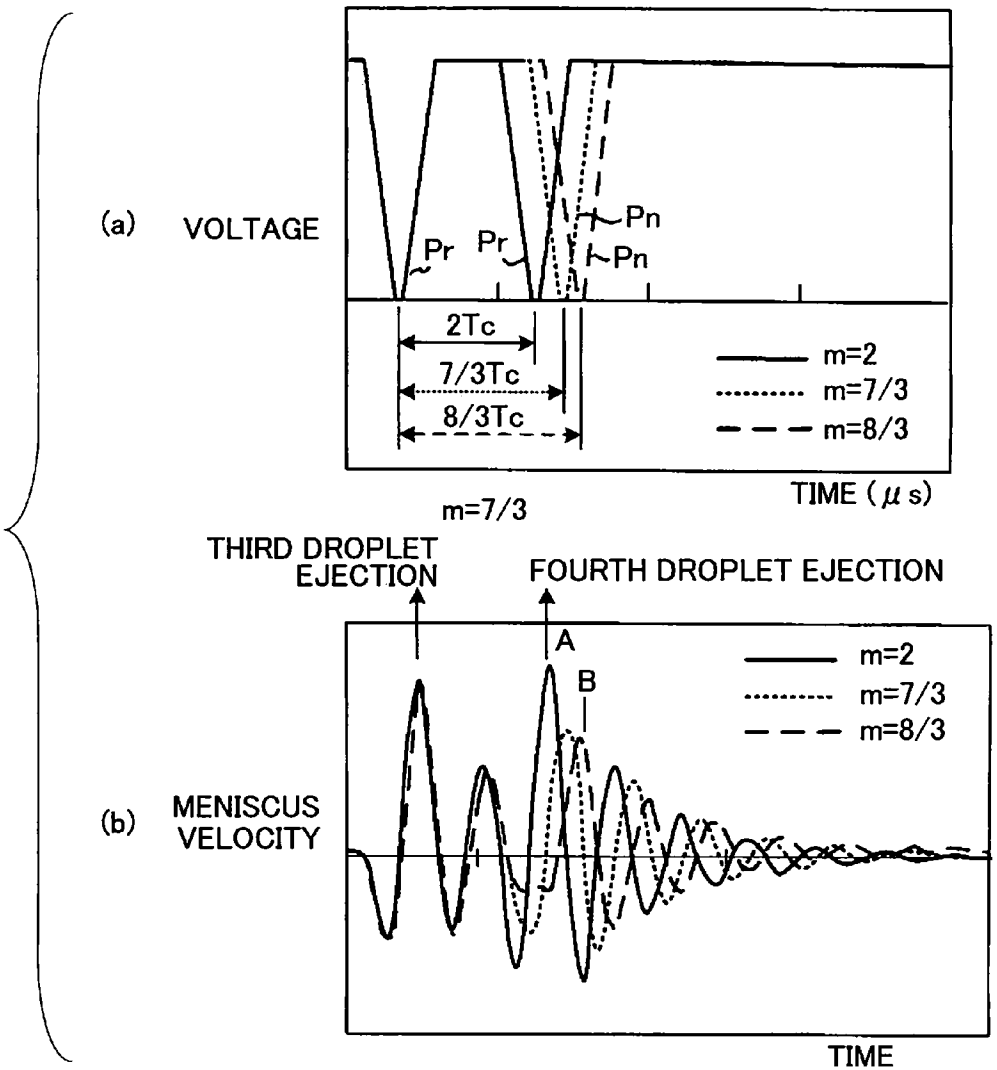
FIG. 10 shows a graph showing the resonant drive pulse and the non-resonant drive pulse and a graph showing a change in the meniscus velocity according to the embodiment of the present invention.

If multiple resonant drive pulses Pr are generated in sequence, the meniscus velocity by a resonant drive pulse Pr is affected by the meniscus velocity by its preceding resonant drive pulse Pr so as to gradually increase. For example, if m is determined as m=2, and the pulse interval Tr for generating the resonant drive pulse Pr is determined as Tr=2Tc and the pulse interval Tn for generating the non-resonant drive pulse Pn is determined as $Tn=(7/3)Tc$ and as $Tn=(8/3)Tc$ as shown in the drive signal of resonant and non-resonant drive pulses of (a) of FIG. 10, the meniscus velocity by the resonant drive pulse Pr and the non-resonant drive pulse Pn changes as shown in (b) of FIG. 10. In the case of causing ink to be ejected by sequentially generating only the resonant drive pulses Pr under m=2, the meniscus velocity of the fourth droplet is excessively greater than that of the third droplet as shown in (b) of FIG. 10, thus making ink ejection unstable. Accordingly, this is not for practical use. Therefore, there is no choice but to select a value greater than two as m in the case of driving using only the resonant drive pulse Pr. This makes the drive wavelength lengthy, thus making it impossible to increase speed. Therefore, according to this embodiment, the ink is ejected up to the third droplet using the non-resonant drive pulse Pn, thereby suppressing the meniscus velocity at the time of ejection of the fourth droplet using the resonant drive pulse Pr of m=2 and ensuring stability. In order to suppress the meniscus velocity at the time of ejection using the resonant drive pulse Pr, the pulse interval Tn for generating the non-resonant drive pulse Pn is determined to be in the antiphase area of the natural vibration of the pressure chamber 146, which is the range of $Tn=(m+1/4)\times Tc$ to $Tn=(m+3/4)\times Tc$, in particular, $Tn=(7/3)Tc$ to $(8/3)Tc$. As a result, the meniscus velocity is suppressed so that it is possible to ensure stability. Further, the pulse interval Tn is reduced so that it is possible to increase printing speed. That is, in the case of suppressing the meniscus velocity at the time of ejection using the resonant drive pulse Pr by employing the non-resonant drive pulse Pn, if the same phase area as that of the resonant drive pulse Pr is used, it is not possible to suppress the meniscus velocity at the time of ejection. Therefore, the pulse interval Tn for generating the non-resonant drive pulse Pn is determined to be in the antiphase area of the natural vibration of the pressure chamber 146, which is the range of $Tn=(m+1/4)\times Tc$ to $Tn=(m+3/4)\times Tc$.

The scanning drive part 102 drives the main scanning motor 17 and the sub scanning motor 18 based on a control signal fed from the main control part 104. The head drive part 103 drives each recording head 14 based on a drive signal output from the drive signal generation part 108.

Next, a description is given of a drive signal generated in the drive signal generation part 108 in the case of forming an image on the recording paper sheet 22 by causing ink droplets to be ejected from the nozzles 145 of the recording heads 14 in this image forming apparatus.

Figure 11:
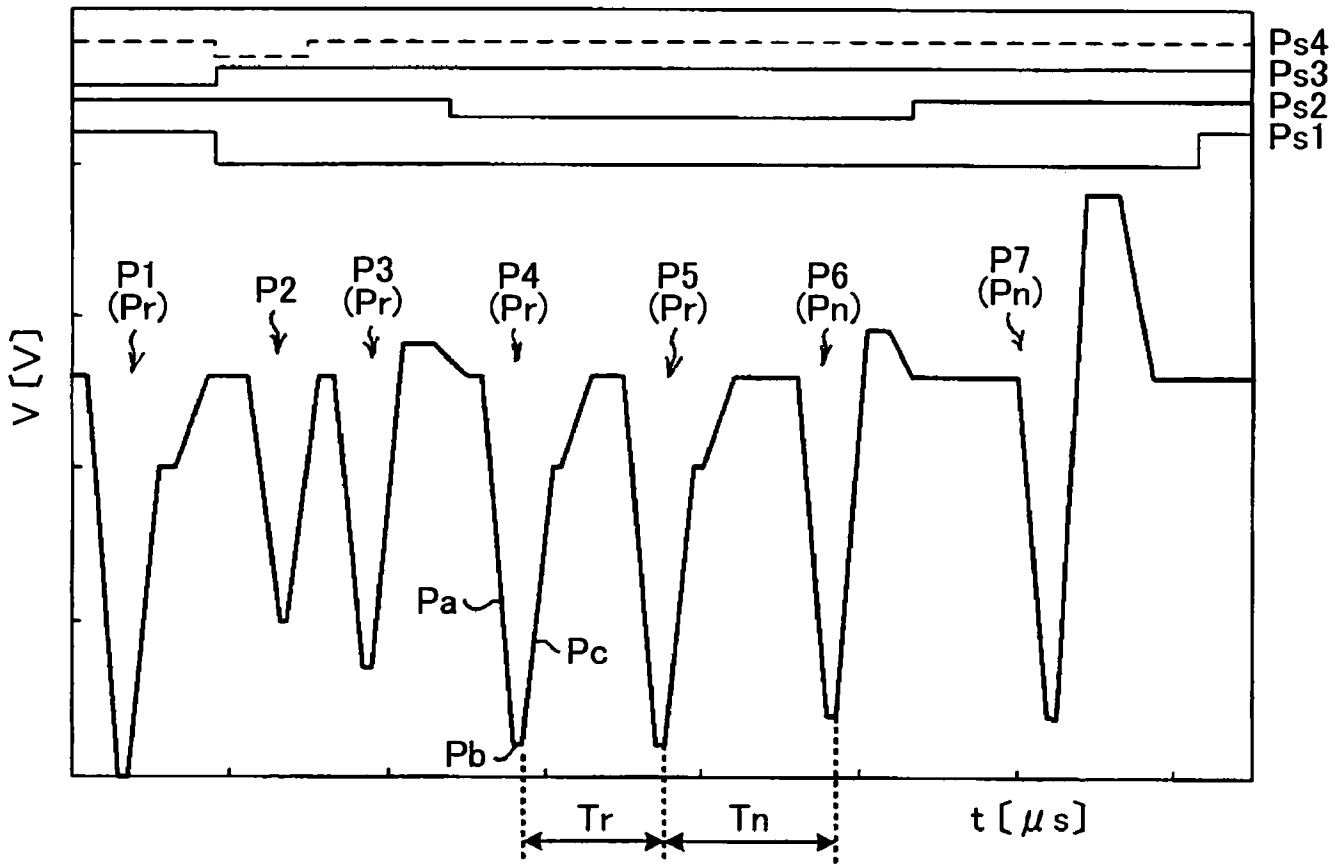
FIG. 11 is a waveform chart showing a drive signal according to the embodiment of the present invention.

The drive signal generated in the drive signal generation part 108 includes multiple drive pulses P1 and P3 through P7 that cause ejection of ink droplets and a slight drive pulse P2 that vibrates a meniscus without causing ejection of an ink droplet within one print cycle as shown in the waveform chart of FIG. 11. The drive pulses P1 and P3 through P7 include multiple resonant drive pulses Pr that increases the volume of an ink droplet using the resonance of the pressure chamber 146 and one or more non-resonant drive pulses Pn that do not utilize the resonance of the pressure chamber 146. The waveform of each drive pulse includes a waveform element Pa that expands the pressure chamber 146, a waveform element Pb that retains the expanded state of the pressure chamber 146, and a waveform element Pc that contracts the expanded pressure chamber 146. The drive signal generation part 108 outputs one or more pulses to the head drive part 103 in accordance with a print signal Ps1, Ps2, or Ps3 or a signal Ps4 transmitted from the main control part 104. For example, when the print signal Ps1 for a large dot is transmitted from the main control part 104, the slight drive pulse P2 and the drive pulses P3 through P7 are output as shown in the waveform chart of (a) of FIG. 12. When the print signal Ps2 for a medium dot is transmitted from the main control part 104, the drive pulses P4 through P6 are output as shown in (b) of FIG. 12. When the print signal Ps3 for a small dot is transmitted from the main control part 104, the drive pulse P1 is output as shown in (c) of FIG. 12. Thus, a single dot is formed by multiple pulses output from the drive signal generation part 108 in accordance with the print signal Ps1, Ps2, or Ps3. Further, when the signal Ps4 that causes the meniscus to vibrate without ejection of an ink droplet is transmitted from the main control part 104, the slight drive pulse P2 is output as shown in (d) of FIG. 12. When this slight drive pulse P2 is output in the drive signal generation part 108, the head drive part 103 provides only vibration to ink inside the pressure chambers 146 corresponding to all the nozzles 145 in a non-printing area and those of the nozzles 145 in a printing area that are not in printing operation so as to vibrate the menisci generated in these nozzles 145, thereby preventing nozzle clogging due to ink drying.

Figure 12:
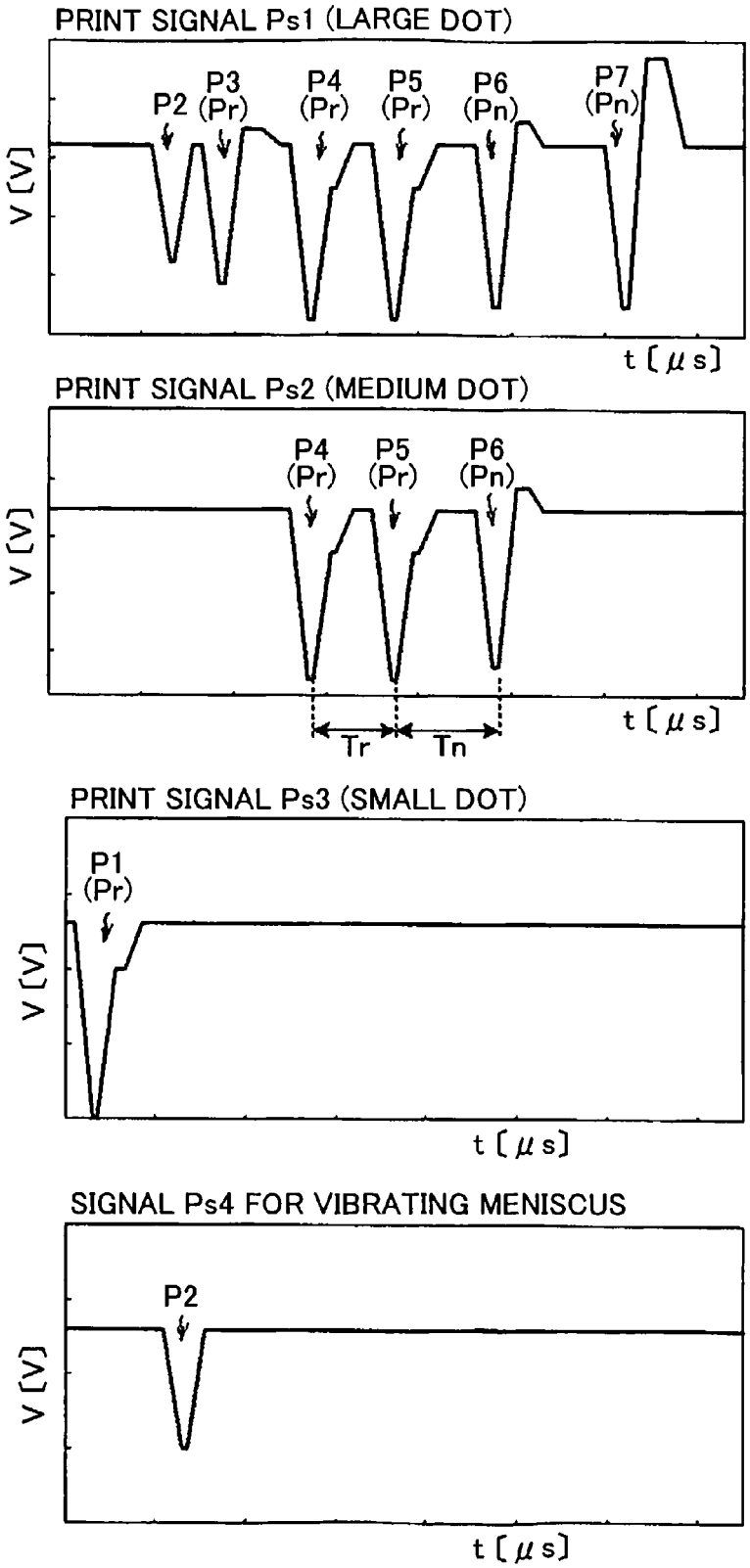
FIG. 12 shows waveform charts of the drive signals in the case of forming a large dot, a medium dot, and a small dot and vibrating a meniscus according to the embodiment of the present invention.

For example, when a drive signal for forming a medium dot is output from the drive signal generation part 108 as shown in (b) of FIG. 12, a first ink droplet is ejected from the nozzle 145 by the first drive pulse P4, and thereafter a second ink droplet is ejected from the nozzle 145 by the second drive pulse P5, which is a resonant drive pulse Pr output at the pulse interval Tr. Here, the drive pulse P4 and the drive pulse P5 are equal in parameter. However, the velocity of the second ink droplet ejected by the drive pulse P5 can be greater than the velocity of the first ink droplet ejected by the drive pulse P4 by using the vibration of the pressure chamber 146 remaining after the ejection of the first ink droplet by the drive pulse P4. The second ink droplet ejected by the drive pulse P5 is combined with the first ink droplet ejected by the drive pulse P4 in air. Further, the drive signal generation part 108 outputs the drive pulse P5, which is a resonant drive pulse Pr, after outputting the drive pulse P4 to the head drive part 103, thereby increasing ejection pressure using the resonance of the pressure chamber 146. Therefore, it is possible to eject an ink droplet greater in volume than in the case of causing ejection solely by the drive pulse P5. In this state, a third ink droplet is caused to be ejected from the nozzle 145 by the third drive pulse P6 so as to be combined with the second ink droplet, which has been combined with the first ink droplet, before landing on the recording paper sheet 22, thereby forming a medium dot on the recording paper sheet 22. Since the third drive pulse P6 is a non-resonant drive pulse Pn, the third drive pulse P6 does not utilize the resonance of the pressure chamber 146. Accordingly, the ejected ink is resistant to ejection curving. That is, employment of the resonant drive pulse Pr for the third drive pulse P6 as for the second drive pulse P5 results in too good efficiency, so that the residual vibration of the meniscus after ink droplet ejection becomes too large. Accordingly, if the ink viscosity is low, it is not possible to prevent the ejected ink droplet from being curved. Therefore, in order to prevent this, the non-resonant pulse Pn is employed as the third drive pulse P6.

An ink droplet of a predetermined size can thus be formed with efficiency and caused to stably land at a predetermined position on the recording paper sheet 22.

Further, when a drive signal for forming a large dot is output from the drive signal generation part 108 as shown in (a) of FIG. 12, no ink droplet is ejected by the first drive pulse P2 because the first drive pulse P2 is a slight drive pulse. However, it is possible to increase the volume of an ink droplet to be ejected by vibrating the meniscus of the nozzle 145 with the drive pulse P2, and causing an ink droplet to be ejected with the second drive pulse P3 in this state. Further, after ejecting the first ink droplet from the nozzle 145 with the second drive pulse P3, a second ink droplet is ejected from the nozzle 145 by the third drive pulse P4 so as to be combined with the first ink droplet in air. In this state, a third ink droplet is ejected from the nozzle 145 by the fourth drive pulse P5 so as to be combined with the second ink droplet united to the first ink droplet in air, thereby increasing volume. Next, a fourth ink droplet and a fifth ink droplet are ejected from the nozzle 145 by the fifth drive pulse P6 and the sixth drive pulse P7, respectively. Thus, the ink droplets are combined one after another before landing on the recording paper sheet 22, thereby forming a large dot on the recording paper sheet 22. Since the slight drive pulse P2 is included in these pulses for forming a large dot, no drive signal length dedicated to the slight drive pulse P2 is required during printing, thus causing no hindrance to high-speed printing.

Figure 13:
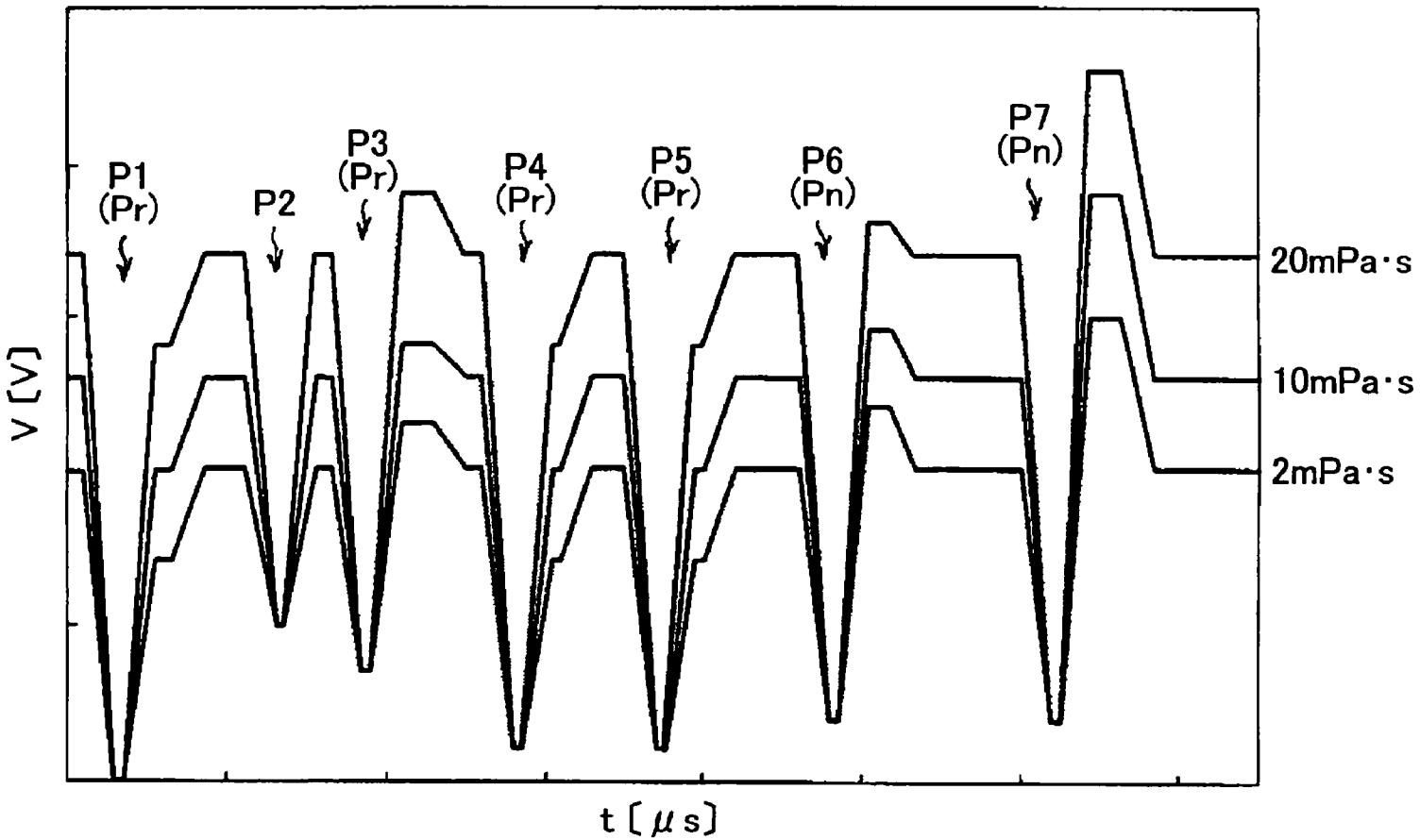
FIG. 13 is a waveform chart showing changes in the drive signal according to ink viscosity according to the embodiment of the present invention.

Thus, a driving signal having the drive pulses P1 and P3 through P7 to cause ejection of ink droplets and the slight drive pulse P2 to vibrate a meniscus without ejection of an ink droplet within one print cycle is generated in the drive signal generation part 108. The vibration of the meniscus after ejecting ink droplets with the drive pulses P1 and P3 through P7 and the vibration of the meniscus with the slight drive pulse P2 differ depending on ink viscosity. When the ink viscosity is high, the vibration has a small amplitude. In order to maintain this meniscus vibration in a predetermined condition, the peak values of the drive pulses P1 and P3 through P7 and the slight drive pulse P2 are selected or determined in accordance with the ink viscosity, that is, the viscosity of ink in an ambient environment, as shown in FIG. 13, which is a waveform chart of drive signals at the time of ink viscosities of 2 mPa·s, 10 mPa·s, and 20 mPa·s. As a result, it is possible to cause the meniscus to stably vibrate so that it is possible to form an ink droplet of a predetermined volume. Further, it is also possible to stably prevent the nozzles 145 from being clogged.

According to one embodiment of the present invention, there is provided an image forming apparatus including: a recording head including a nozzle from which liquid droplets are ejected, a pressure chamber communicating with the nozzle and containing liquid, and a pressure generation part changing the volume of the pressure chamber; and a drive signal generation part configured to generate a drive signal including multiple drive pulses, the drive signal causing the pressure generation part of the recording head to operate so that the liquid droplets are ejected from the nozzle, wherein the drive signal generated by the drive signal generation part includes, within a single print cycle, a resonant drive pulse causing a first one of the liquid droplets to be ejected using the natural vibration period of the pressure chamber, a non-resonant drive pulse causing a second one of the liquid droplets to be ejected without using the natural vibration period of the pressure chamber, and a slight drive pulse prevented from causing the ink droplets to be ejected.

According to one aspect of the present invention, by generating a drive signal including multiple drive pulses that causes liquid droplets to be ejected and a slight drive pulse that does not cause a liquid droplet to be ejected within a single print cycle, it is possible to maintain a nozzle in the single print cycle, thus making it possible to increase the speed and stability of printing.

According to another aspect of the present invention, since the drive pulses causing liquid droplets to be ejected include a resonant drive pulse that causes a liquid droplet to be ejected using the natural vibration period of a pressure chamber and a non-resonant drive pulse that causes a liquid droplet to be ejected without using the natural vibration period of the pressure chamber, it is possible to form liquid droplets of a large dot and a medium dot at high speed with stability.

Additionally, in the image forming apparatus as set forth above, the drive signal generation part may determine the pulse interval between the resonant drive pulse and one of the drive pulses preceding the resonant drive pulse with respect to the natural vibration period of the pressure chamber so that the pulse interval satisfies $Tr=m\times Tc$, where Tr is the pulse interval, Tc is the natural vibration period of the pressure chamber, and m is a value less than or equal to two.

As a result, the pulse interval Tr is reduced so that it is possible to increase printing speed.

Additionally, in the image forming apparatus as set forth above, the drive signal generation part may determine the pulse interval between the non-resonant drive pulse and one of the drive pulses preceding the non-resonant drive pulse with respect to the natural vibration period of the pressure chamber so that the pulse interval is in the range of $Tn=(m+1/4)\times Tc$ to $(m+3/4)\times Tc$, particularly $Tn=(m+1/3)\times Tc$ to $(m+2/3)\times Tc$, where Tn is the pulse interval, Tc is the natural vibration period of the pressure chamber, and m is a value less than or equal to two.

Thus, the meniscus velocity in the case of successively ejecting ink droplets is suppressed using a non-resonant drive pulse, thereby ensuring stability. As a result, it is possible to increase printing speed.

Additionally, in the image forming apparatus as set forth above, the drive signal generation part may determine a first pulse interval between the resonant drive pulse and one of the drive pulses preceding the resonant drive pulse with respect to the natural vibration period of the pressure chamber so that the first pulse interval satisfies Tr=2Tc±0.5 μs, and may determine a second pulse interval between the non-resonant drive pulse and one of the drive pulses preceding the non-resonant drive pulse with respect to the natural vibration period of the pressure chamber so that the second pulse interval is in the range of Tn=7Tc/3 to 8Tc/3, where Tr is the first pulse interval, Tn is the second pulse interval, and Tc is the natural vibration period of the pressure chamber.

As a result, it is possible to perform high-frequency driving with stability.

Additionally, the drive signal generation part may generate the drive signal having a different combination of the drive pulses depending on a print signal for forming a single dot.

As a result, it is possible to stably form a liquid droplet of a size according to a print signal.

Additionally, in the image forming apparatus as set forth above, the drive signal generation part may generate the drive signal having the non-resonant drive pulse immediately after the resonant drive pulse.

As a result, it is possible to stably form an image of good quality by suppressing the curving of an ejected liquid droplet.

Additionally, in the image forming apparatus as set forth above, the drive signal generation part may generate the slight drive pulse so that the slight drive pulse is provided among multiple drive pulses causing the ink droplets to be ejected within the single print cycle, and may generate one of the drive pulses with the meniscus of the nozzle being vibrated by the slight drive pulse.

As a result, it is possible to increase the volume of a liquid droplet ejected from a nozzle.

Additionally, in the image forming apparatus as set forth above, each of the drive pulses and the slight drive pulse generated in the drive signal generation part may include a first waveform element expanding the pressure chamber so that the meniscus of the nozzle is drawn in toward the side of the pressure chamber and a second waveform element contracting the expanded pressure chamber.

As a result, it is possible to ensure nozzle maintenance and a further increase in printing speed.

Additionally, in the image forming apparatus as set forth above, the drive signal generation part may change a peak value of each of the drive pulses and the slight drive pulse in accordance with the viscosity of the liquid in a use environment, and the liquid may have a viscosity of 2 mPa·s to 20 mPa·s.

As a result, it is possible to stably vibrate a meniscus so that it is possible to form a liquid droplet of a predetermined volume. Further, it is also possible to prevent a nozzle from being clogged.

The present invention is not limited to the specifically disclosed embodiment, and variations and modifications may be made without departing from the scope of the present invention.

The present application is based on Japanese Priority Patent Applications No. 2005-350090, filed on Dec. 5, 2005, and No. 2006-273543, filed on Oct. 5, 2006, the entire contents of which are hereby incorporated by reference.

The invention claimed is:

1. An image forming apparatus, comprising:

a recording head including a nozzle from which liquid droplets are ejected, a pressure chamber communicating with the nozzle and containing liquid, and a pressure generation part changing a volume of the pressure chamber; and a drive signal generation part configured to generate a drive signal including a plurality of drive pulses, the drive signal causing the pressure generation part of the recording head to operate so that the liquid droplets are ejected from the nozzle, wherein the drive signal generated by the drive signal generation part includes, within a single print cycle, a resonant drive pulse causing a first one of the liquid droplets to be ejected using a natural vibration period of the pressure chamber, a non-resonant drive pulse causing a second one of the liquid droplets to be ejected without using the natural vibration period of the pressure chamber, and a slight drive pulse prevented from causing the ink droplets to be ejected.

2. The image forming apparatus as claimed in claim 1, wherein the drive signal generation part determines a pulse interval between the resonant drive pulse and one of the drive pulses preceding the resonant drive pulse with respect to the natural vibration period of the pressure chamber so that the pulse interval satisfies Tr=m×Tc, where Tr is the pulse interval, Tc is the natural vibration period of the pressure chamber, and m is a value less than or equal to two.

3. The image forming apparatus as claimed in claim 1, wherein the drive signal generation part determines a pulse interval between the non-resonant drive pulse and one of the drive pulses preceding the non-resonant drive pulse with respect to the natural vibration period of the pressure chamber so that the pulse interval is in a range of Tn=(m+¼)×Tc to (m+¾)×Tc, where Tn is the pulse interval, Tc is the natural vibration period of the pressure chamber, and m is a value less than or equal to two.

4. The image forming apparatus as claimed in claim 1, wherein the drive signal generation part determines a pulse interval between the non-resonant drive pulse and one of the drive pulses preceding the non-resonant drive pulse with respect to the natural vibration period of the pressure chamber so that the pulse interval is in a range of Tn=(m+⅓)×Tc to (m+⅔)×Tc, where Tn is the pulse interval, Tc is the natural vibration period of the pressure chamber, and m is a valueless than or equal to two.

5. The image forming apparatus as claimed in claim 1, wherein the drive signal generation part determines a first pulse interval between the resonant drive pulse and one of the drive pulses preceding the resonant drive pulse with respect to the natural vibration period of the pressure chamber so that the first pulse interval satisfies Tr=2Tc±0.5 μs, and determines a second pulse interval between the non-resonant drive pulse and one of the drive pulses preceding the non-resonant drive pulse with respect to the natural vibration period of the pressure chamber so that the second pulse interval is in a range of Tn=7Tc/3 to 8Tc/3, where Tr is the first pulse interval, Tn is the second pulse interval, and Tc is the natural vibration period of the pressure chamber.

6. The image forming apparatus as claimed in claim 1, wherein the drive signal generation part generates the drive signal having a different combination of the drive pulses depending on a print signal for forming a single dot.

7. The image forming apparatus as claimed in claim 1, wherein the drive signal generation part generates the drive signal having the non-resonant drive pulse immediately after the resonant drive pulse.

8. The image forming apparatus as claimed in claim 1, wherein the drive signal generation part generates the slight drive pulse so that the slight drive pulse is provided among multiple drive pulses causing the ink droplets to be ejected within the single print cycle, and generates one of the drive pulses with a meniscus of the nozzle being vibrated by the slight drive pulse.

9. The image forming apparatus as claimed in claim 1, wherein each of the drive pulses and the slight drive pulse generated in the drive signal generation part includes a first waveform element expanding the pressure chamber so that a meniscus of the nozzle is drawn in toward a side of the pressure chamber and a second waveform element contracting the expanded pressure chamber.

10. The image forming apparatus as claimed in claim 1, wherein the drive signal generation part changes a peak value of each of the drive pulses and the slight drive pulse in accordance with a viscosity of the liquid in a use environment.

11. The image forming apparatus as claimed in claim 1, wherein the liquid has a viscosity of 2 mPa·s to 20 mPa·s.

* * * * *